United States Patent [19]

Howeth

[11] 3,942,325

[45] Mar. 9, 1976

[54] HYDRAULIC THROTTLE ACTUATOR

[76] Inventor: David Franklin Howeth, 1207 Elizabeth Blvd., Granbury, Tex. 76048

[22] Filed: Nov. 30, 1973

[21] Appl. No.: 420,533

Related U.S. Application Data

[63] Continuation-in-part of Ser. No. 252,005, May 10, 1972, Pat. No. 3,397,967.

[52] U.S. Cl. ..... 60/533; 91/416; 60/468; 60/558

[51] Int. Cl.[2] ..... F15B 7/00

[58] Field of Search ..... 417/34; 60/563, 593, 583, 60/560, 565, 533, 468; 91/415–417; 137/101

[56] References Cited

UNITED STATES PATENTS

| | | | |
|---|---|---|---|
| 1,970,999 | 8/1934 | Ferris et al. | 60/563 |
| 2,447,441 | 8/1948 | Tweedale | 60/468 |
| 2,462,983 | 3/1949 | Mac Duff et al. | 137/101 X |
| 2,563,295 | 8/1951 | Westbury | 91/417 R X |
| 2,640,546 | 6/1953 | Baker | 60/533 X |
| 2,737,196 | 3/1956 | Eames | 137/101 |
| 3,157,986 | 11/1964 | Gordon | 60/563 X |
| 3,173,264 | 3/1965 | Hazeltine | 60/563 |
| 3,173,339 | 3/1965 | Larsen | 60/533 X |
| 3,186,173 | 6/1965 | Hogg | 60/563 |
| 3,473,328 | 10/1969 | Mayhew | 60/563 |

FOREIGN PATENTS OR APPLICATIONS

| | | | |
|---|---|---|---|
| 1,249,823 | 11/1960 | France | 60/533 |
| 370,129 | 2/1923 | Germany | 60/533 |
| 813,061 | 5/1937 | France | 60/533 |
| 1,169,686 | 1/1959 | France | 60/533 |
| 669,995 | 4/1952 | United Kingdom | 60/533 |

*Primary Examiner*—Martin P. Schwadron
*Assistant Examiner*—H. Burks, Sr.
*Attorney, Agent, or Firm*—Wm. T. Wofford

[57] ABSTRACT

A throttle actuator for accelerating and decelerating the speed of an internal combustion engine in response to work demand where the engine drives the pump of a hydraulic system. In one aspect, the invention is directed to a throttle actuating piston and rod arrangement for operating the throttle of the engine and a pulsation intensifier for sensitively controlling the piston's movement. The pulsation intensifier is connected in a pressure line from the pump and comprises a free spring biased floating piston of configuration such that there is a differential in area across the piston for fluid pressure intensification purposes. The intensifier piston in one embodiment also has an axial passage therethrough and an orifice communicating with the throttle actuating piston. Both pistons are slidably mounted in housings which have springs to normally position the pistons in directions to cause the engine to return to idle speed when there is no work demand.

3 Claims, 6 Drawing Figures

HYDRAULIC THROTTLE ACTUATOR

BACKGROUND OF THE INVENTION

This invention relates to hydraulic throttle actuators such as those used for accelerating and decelerating an internal combustion engine which drives a pump in a hydraulic system. Particularly, the invention is directed to that type of throttle actuator which is operated responsive to pressure changes within the system resulting from the positioning of a selector valve and work demand.

Although the invention is primarily intended for use in conjunction with the prime mover of mobile equipment, it is adaptable for use with other hydraulic systems where the pump of the system is driven by an internal combustion engine. In many cases the hydraulic system is used only when the mobile equipment is in a stationary condition, the system itself being operated on an intermittent basis. The hydraulic systems generally are designed in such a manner that during inoperative periods, the valving in the system allows fluid, which is being pumped on a continuous basis, to pass through certain portions of the system and return back to the reservoir—thus fluid is in a constant state of movement whether the system is doing work or is in an idle condition. This type of system is referred to as an open-center hydraulic system. To those skilled in the art it will be apparent that certain rotary control valves, not shown, may be used, but for the purpose of the present disclosure reference will be made to a spool selector valve. In a system as herein described, when work is demanded of the system, the speed of the internal combustion engine is increased to cause the pump to apply fluid at higher pressures and flow rates. The most common means for controlling engine speeds utilizes fluid pressure from the hydraulic system itself, and is actuated only upon demand. Such means are normally called hydraulic throttle actuators. Although several hydraulically operated throttle actuators are presently available, they have operational disadvantages in that they are incapable of operating over the broad range of pressures encountered in such hydraulic systems and particularly are incapable of accurately sensing lower pressures.

SUMMARY OF THE INVENTION

One object of the invention is to provide a hydraulic throttle actuator capable of sensing the full range of pressures encountered in the hydraulic system, whereby the engine can be accelerated and decelerated in a manner to achieve optimum performance of the hydraulic system.

A further object is to provide, in an open center hydraulic system, spring adjustment means to overcome high back pressures encountered when the engine is running at a high speed and the selector valve is shifted to the no work demand position.

Another object of the invention is to provide a fluid intensifier effective in a hydraulic system to intensify pressure pulses to overcome the force of a return spring acting on the throttle actuating piston under a work cycle condition wherein such pressure pulses are of less magnitude than the system maximum back pressure.

Another object is to provide a hydraulic throttle actuator having means for accurately adjusting the stroke of the throttle actuating piston.

These and other objects of the invention will become apparent from the following description and the accompanying drawings,

DETAILED DESCRIPTION OF THE INVENTION

Figure 1:
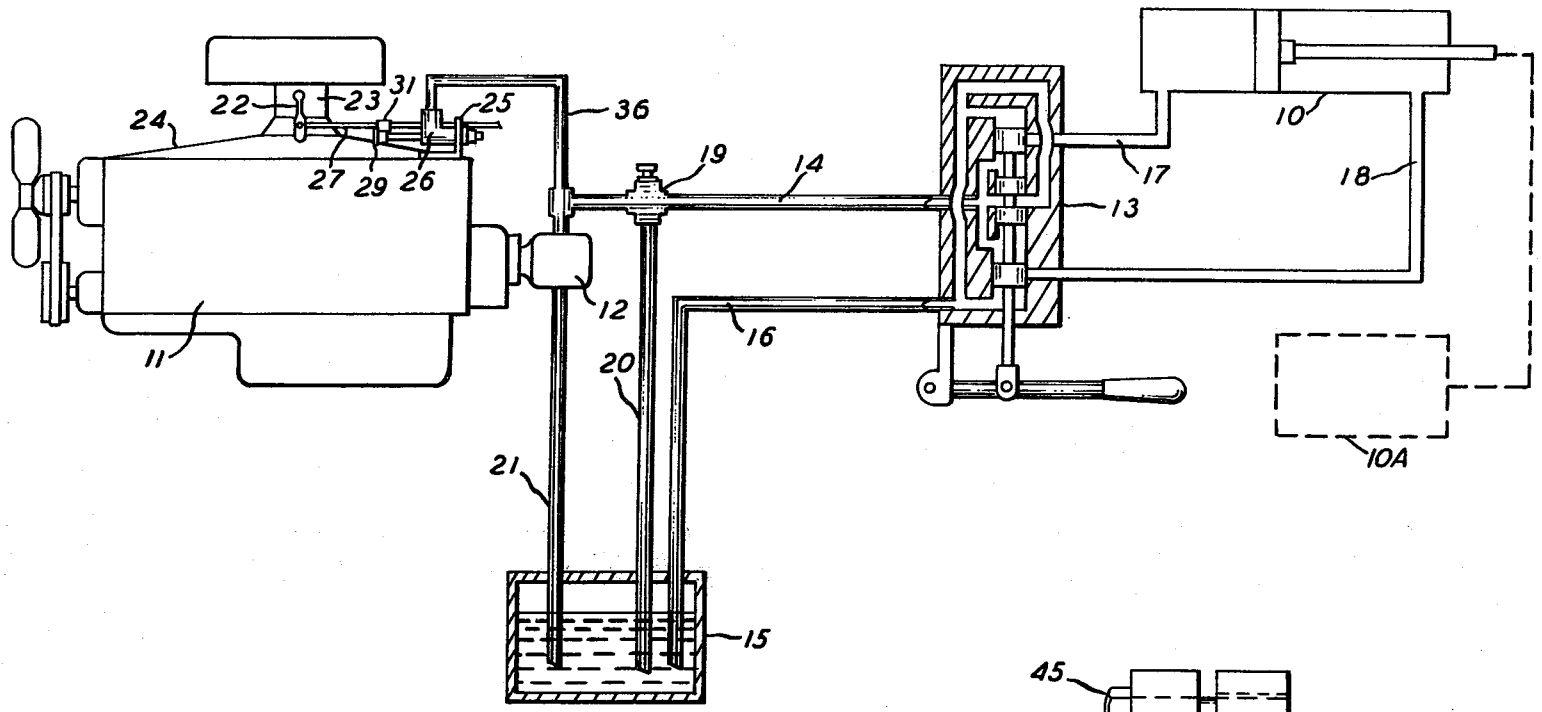
FIG. 1 is a schematic diagram of a hydraulic system employing a throttle actuator according to the invention.

The hydraulic system shown in FIG. 1 is for a mobile unit having a working cylinder 10 for operating any of various hydraulically operated implements, illustrated in block form at 10A, and which may include for example cranes, packer blades in refuse trucks, tailgate hoists, back hoes on tractors, etc. The engine 11 shown is a prime mover for a vehicle and also drives a hydraulic fluid pump 12 which is part of the hydraulic system. The selector valve 13 is conventional and is not, therefore, herein described in detail. The valve 13 is connected with the pump 12 by a pressure line 14 and with a fluid reservoir tank 15 by a return line 16. Similarly, working lines 17 and 18 extend to the ends of the cylinder 10. The system as shown includes a regulator valve 19 in the pressure line 14 and a bypass line 20 to the reservoir 15. To complete the primary system, there is a supply line 21 connecting the reservoir 15 with the pump 12.

A throttle actuator according to the present invention operates the throttle lever 22 of the engine's carburetor 23 and, as shown, is mounted on the engine head 24 by means of a clamp bracket 25. A cylinder 26, herein referred to as an actuator cylinder, is mounted in the clamp bracket 25 parallel with the engine's accelerator rod 27. A throttle actuating piston 28 (see FIG. 2) is slidably mounted in the cylinder 26 and has a circular flange 29 on the extending end of its piston rod 30 for contacting an adjustable stop 31 on the engine's accelerator rod 27. Piston rings, cylinder seals and means for mounting the flange 29 on the piston rod are shown but not numbered.

Within the actuator cylinder 26, and in the end thereof opposite the piston rod 30, there is a coiled piston return spring 32 which normally extends the flange 29 outwardly of the cylinder. A cylindrical spring adjuster 33 is threaded in and projects from the cylinder 26 and adjusts the compression of the piston return spring 32. A stop 34 is threaded through the axis of the spring adjuster 33 and adjustably limits the stroke or travel of the piston 28.

A pulsation intensifier cylinder 35 has one end 35A connected with the system's pressure line 14 by an auxiliary pressure line 36A. The other end 35B of the cylinder 35 is connected with the cylinder 26 and is in fluid communication therewith by way of an opening 26A formed in the cylinder 26 at the rod end of the piston 28, in the embodiment of FIG. 2.

Figure 2:
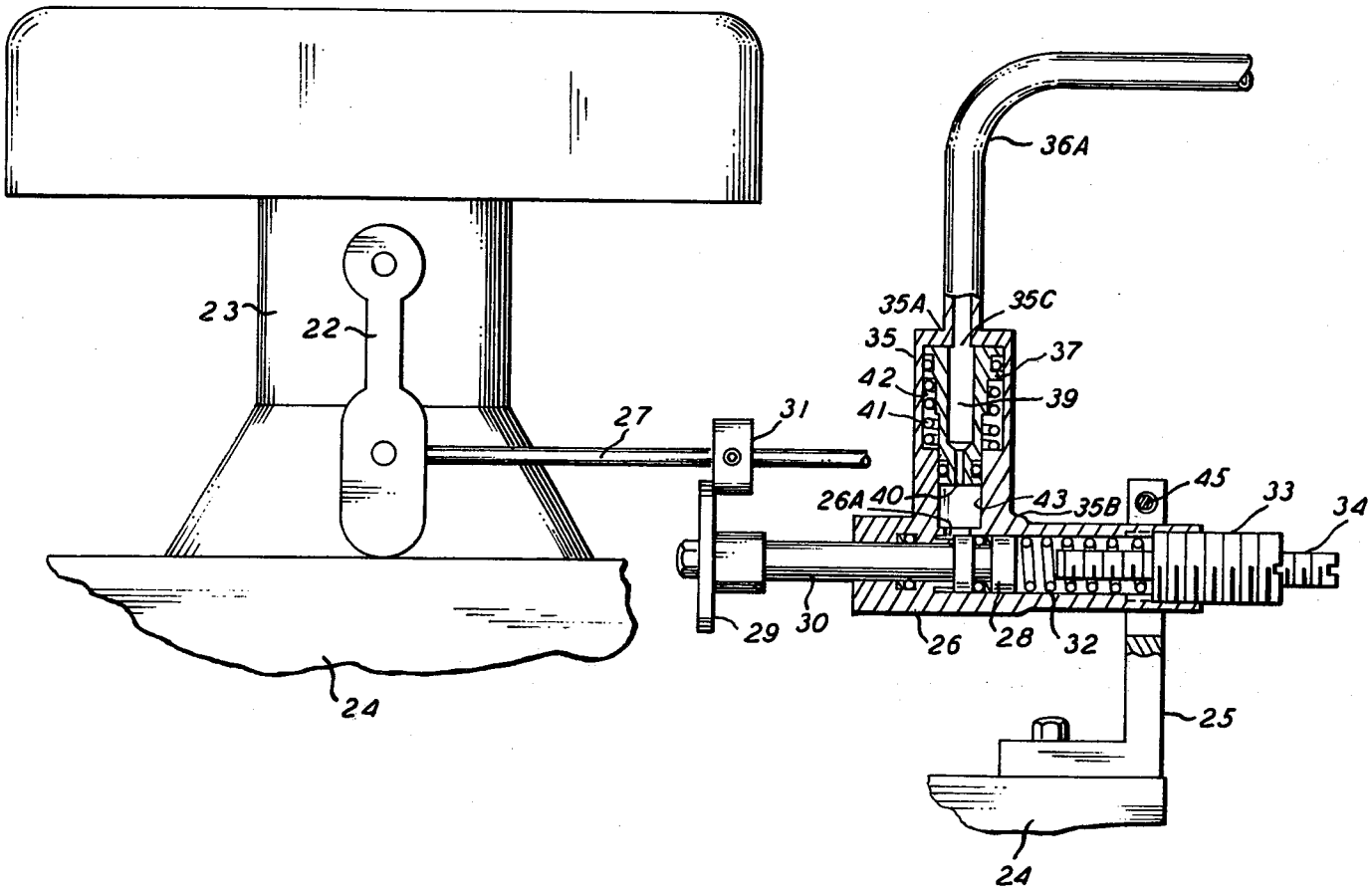
FIG. 2 is an enlarged vertical sectional view of the actuator shown in FIG. 1 and showing the same connected with the throttle lever of an internal combustion engine.
Figure 4:
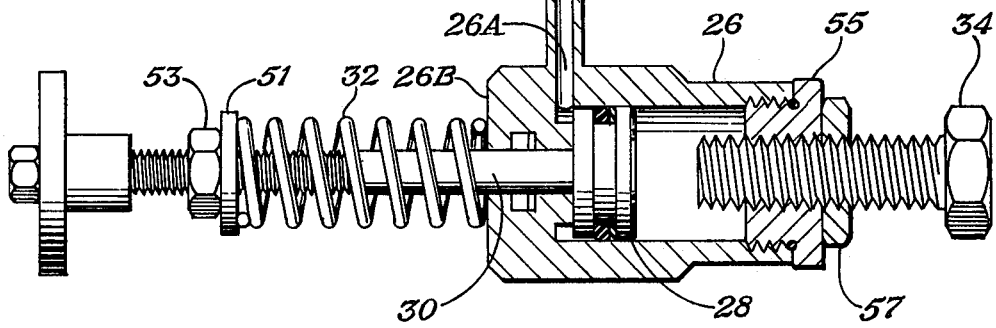

In FIG. 2, the intensifier cylinder 35 is connected directly with the actuator cylinder 26. The intensifier cylinder 35 of FIG. 4 is the same as that of FIG. 2 except that it is connected with an actuator cylinder by way of a length of conduit 36B. Reference will be made both to FIG. 2 and FIG. 4 for a detailed description of the intensifier cylinder 35.

Cylinder 35 has openings 35C and 35D in opposite ends thereof and bores 42 and 43 of different size diameters respectively. Located within the cylinder 35 is a free-floating intensifier piston 37 having ends 37A and 37B of different size diameters for sliding movement in the bores 42 and 43 respectively of the cylinder 35. The intensifier 37 has oppositely facing surfaces of different areas to be exposed to the hydraulic fluid for providing a differential in area across the piston for fluid pressure intensification purposes. These surfaces include surfaces 37C and 37D facing in one direction and surface 37E facing in an opposite direction. Although not illustrated in FIG. 2, the end of the cylinder 35 surrounding the opening 35C may be curved or conical-shaped as illustrated at 35E in FIG. 4 to allow surface 37C always to be exposed to the hydraulic fluid.

Extending through the intensifier piston 37 is an axial passageway 39 which provides a continuously open, two-way fluid flow path between the openings 35A and 35B in opposite ends of the cylinder 35. The piston 37 has an orifice 40 or restricted opening at one end to allow restricted flow through the piston 37 to and from the actuator piston. A coiled reset spring 41 around the smaller diameter 37B of the piston 37 normally positions the piston 37 adjacent the cylinder's connection with the auxiliary pressure line 36A. As illustrated the spring 41 seats on shoulders 35F and 37F formed in cylinder 35 and on piston 37 respectively.

When the selector valve 13 is in its neutral or open center position and the engine 24 is operating at idle speed, hydraulic fluid is circulated by the pump 12 at a low pressure and at which time the engine 11 is running at low speed. However, when the valve 13 is manipulated to actuate the working cylinder 10 the pressure in the pressure line 14 and the auxiliary line 36A is increased and moves the actuator piston 28 away from the cylinder opening 26A against the force of the return spring 32 in the cylinder 26. The flange 29 on the piston rod 30 moves the stop 31 on the accelerator rod 27 and thus operates the throttle lever 27 to increase the engine speed. After the selector valve 13 has been returned to neutral, the pressures are decreased and the return spring 32 extends the piston rod 30, and thus returns the throttle lever to its idle position.

Since the spring biased intensifier piston 37 has a difference in transverse area, any pressure pulse acting against the larger face of the piston 37 moves the piston in the cylinder 35 and, in turn, compresses fluid against the actuator piston 28 at a rate faster than it can return through the pressure balancing orifice 40. Thus, any system fluid pressure pulses are intensified on the smaller side of the piston 37 in proportion to the differential in area across the piston, less the small loss back through the restricting orifice 40.

During those portions of a work cycle of the hydraulic system when working pressures are required that are lower than the maximum back pressure, fluid intensification by the fluid intensifier is very important in order to overcome the high compression force of the actuator piston return spring, the latter of which compression force is required in order to overcome the high back pressures encountered when the engine is running at a high speed and the selector valve is shifted to the no work demand position.

One instance where the working pressures are lower than the maximum back pressure, occurs in the starting of a work cycle occasioned by shifting the selector valve, for example, to lower the boom of a crane. In the normal selector valve shifting operations, minute pressure pulses generally are produced by the flats or lands of the spool valve passing over the flats or lands of the valve body. Further minute pressure pulses are produced in the beginning portion of the work cycle as various system components, such as cylinder pistons, rods, and seals, go through a transition from the static to the dynamic condition. The present intensifier is capable of intensifying these small pressure pulses to values above the maximum pressure setting of the actuator return spring so that the actuator piston will be moved to effectively accelerate the engine during this portion of the work cycle.

When a pressure pulse occurs, for example in the starting of a work cycle, it will rapidly move the piston 37 to intensify the fluid pressure on its smaller side and at the same time compress the reset spring 41. The restricting orifice 40 delays bleedback of the fluid through the piston 37 and hence delays resetting of piston 37 to allow the next pressure pulse to shift the piston 37 further in the event that it has not reached its full stroke. The pressure pulses may occur relatively close together such that the orifice 40 is effective to allow the intensifier piston to continue to intensify the pressure pulses, thus causing the engine to be accelerated.

The restricting orifice 40 acts to delay bleedback of the fluid through the piston 37 such that sufficient pressure is maintained on the actuator piston 28 to prevent any significant return movement thereof during a period of pressure rebalance, during which period, the intensified pressure on the actuator piston 28 is relatively constant while the working pressure is increasing toward the level of the intensified pressure. When a pressure balance is reached across the piston 37 by way of the restricting orifice 40, the reset 41 returns the piston 37. When this occurs, the piston 37 is reset and hence is ready for any further pressure intensififer action that may be required. The piston 37 is capable of doing work as long as there is stroke left in the actuator piston. In the event that a pressure pulse shifts the piston 37 its full stroke and the working pressure is higher than the back pressure, the fluid pressure will continue to flow through the passageway 39 to move the actuator piston as long as it has not reached its full stroke.

When the boom of a crane is being raised, the selector valve is shifted to stop movement of the boom when its desired height is reached. At that time, the engine is running at its maximum throttle setting and fluid is being pumped and bypassed at a maximum rate whereby a very high back pressure is created. As indicated above, the setting of the return spring of the actuator cylinder is adjusted to overcome the high back pressure to return the actuator piston to its normal position whereby the engine may be returned to idle after the operating cycle. When the return spring pushes the actuator piston back to its normal position, fluid is squeezed back through the intensifier piston orifice to the larger side of the piston 37 thereby allowing the actuator piston to be returned to its normal position at a relatively slow rate and hence allowing the engine to be gradually decelerated.

This somewhat delayed or gradual engine deceleration action results in certain advantages. For example, since the engine does not immediately decelerate when a first selector valve is centered, a second work valve may be shifted to start a second work function while the engine speed is still near its normal work speed.

A further example where the fluid intensifier is useful in overcoming the high compression force of the return spring, occurs in the lowering of outriggers of a truck crane to stabilize the crane prior to a lifting operation. In the lowering of these outriggers, there is no high pressure required since the outriggers will almost "free-fall". As the selector valve is shifted and the outriggers begin to descend, there is no high pressure buildup, so that the engine remains essentially at idle. Thus, normally it would take a long period of time for the outriggers to descend to ground level. It is desirable, however, to have the engine operate at a higher rate of speed to obtain more fluid flow to bring the outriggers down at a faster rate. This is accomplished with the present intensifier which senses and intensifies the small pressure pulses occurring during the beginning portion of this work cycle to cause the engine to speed up or accelerate so that the outriggers are lowered at a rapid rate.

In a typical application, the ratio of the larger surface relative to that of the smaller and oppositely facing surface of the intensifier piston 37 is 3.5 to 1. The orifice 40 has a length of 0.94 of an inch and a diameter of 0.09 of an inch. The high pressure supply chamber comprising the volume of the bore 43, with the piston 37 in its normal position, is 0.095 of a cubic inch. The actuator return spring 41 is capable of overcoming a maximum back pressure of 300 p.s.i.

Figure 3:
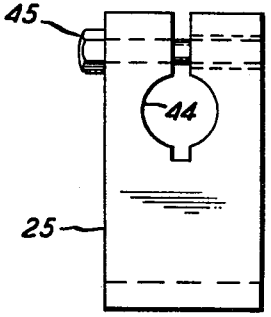
FIG. 3 is a front elevational view of a clamp bracket for adjustably supporting the cylinder of the throttle actuator piston.

Now that one embodiment of the invention has been described, other embodiments and modifications will be discussed. In addition to the means 34 for adjusting the stroke of the piston 28, in the embodiment of FIG. 2, the actuator cylinder 26 may be longitudinally adjusted in the bracket 25. As best shown in FIG. 3, the bracket 25 is provided with a split opening 44 for receiving the cylinder 26 and a bolt 45 in the bracket near the split end of the opening for adjusting the spacing between the actuator cylinder 26 and the stop 31 on the accelerator rod 27.

Figure 5:
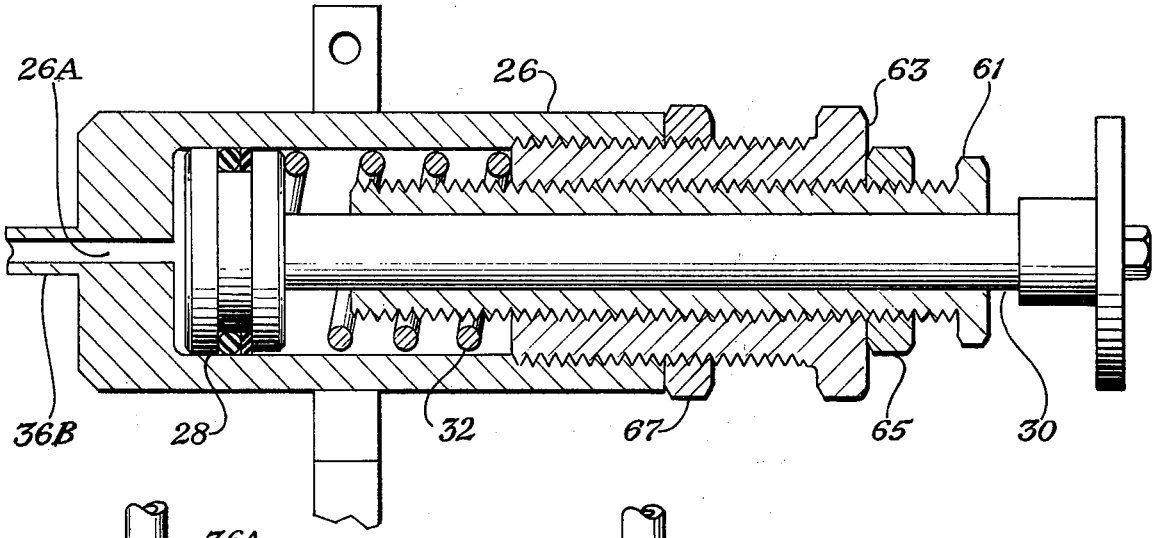
FIGS. 4, 5, and 6 illustrate further embodiments of the invention.
Figure 5:
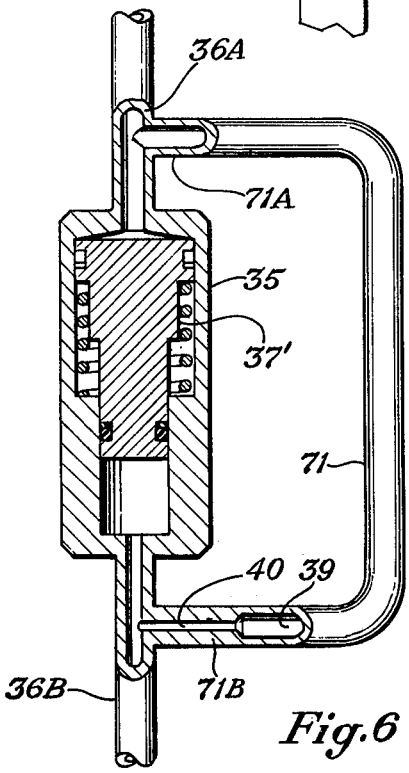

Referring now to FIGS. 4 and 5, there will be described alternative embodiments of the invention. In the embodiment of FIG. 4, the return spring 32 is located on the outside of the cylinder 26 and seats against the cylinder face 26B and a washer 51 held in place by an adjustable nut 53 threaded to the piston 30. In this embodiment, the spring also urges the rod 30 and the actuator piston 28 toward the left, as shown in FIG. 4, to normally maintain the piston 28 next to the opening 26A. The compression force of the spring 28 may be adjusted by adjustment of the nut 53. The adjustable stop 34 is threaded into sleeve 55 and held securely by a nut 57.

In the embodiment of FIG. 5, the return spring 32 is located within the cylinder 26 and normally urges the piston 28 towards the opening 26A. The piston rod 30 is located on the same side of the piston 28 and extends through the spring 32 and through a sleeve 61 which is employed as the stop for adjusting the stroke of the piston. Sleeve 61 is threaded into sleeve 63 which in turn is threaded into cylinder 26. Sleeve 63 is employed for adjusting the compression force of the spring 32. Nuts 65 and 67 are provided for securely holding the sleeves 61 and 63 in place. Although not shown, suitable coupling will be had between the piston rod 30 and the throttle lever 22, and the cylinder 26 will be located in a position whereby movement of the piston 28 and piston rod 30 away from the opening 26A will move the engine's throttle lever 22 in a direction to accelerate the engine.

Figure 6:
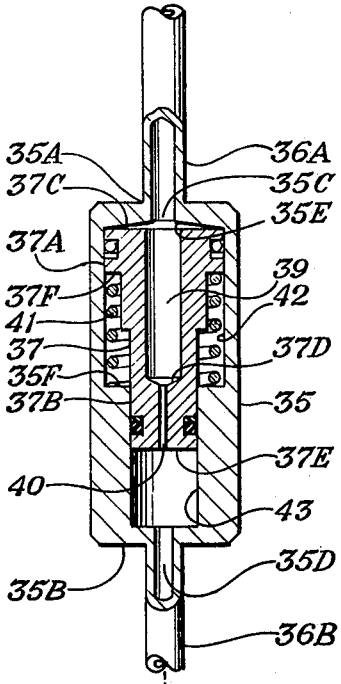

In the embodiment of FIG. 6, the passageway 39 and orifice 40 are formed by a conduit 71 which has opposite ends 71A and 71B coupled to the conduits 36A and 36B respectively to provide a stationary, two-way fluid passageway between the ends of the cylinder 35 and which bypasses the cylinder 35. In this embodiment the intensifier piston 37' is a solid member with no passageway extending therethrough. The two-way passageway of FIG. 6, formed by conduit 71, and which bypasses the cylinder 35 and hence the piston 37', provides the same functions as the axial passageway 39 and orifice 40 of the embodiments of FIGS. 2 and 4.

The invention is not limited to the exemplary construction herein shown and described, but may be made in various ways within the scope of the appended claims.

I claim:

1. A fluid pressure intensifier for use in a hydraulic system comprising:

a cylinder having openings in opposite ends thereof, a free-floating piston located in said cylinder for movement therein, said piston having oppositely facing surfaces of different areas to be exposed to hydraulic fluid by way of said openings for providing a differential in area across said piston for fluid pressure intensification purposes, the larger of said surfaces facing one end of said cylinder, biasing means for normally urging said piston toward said one end of said cylinder, and a continuously open passageway including a restrictive orifice communicating between the ends of said cylinder on opposite sides of said piston for providing a two-way fluid flow passageway between the ends of said cylinder.

2. The fluid pressure intensifier of claim 1 wherein said continuously open passageway including said restrictive orifice extends through said piston.

3. The fluid pressure intensifier of claim 1 wherein said continuously open passageway including said restrictive orifice comprise a two-way fluid passageway coupled to opposite ends of said cylinder and which bypasses said cylinder.

* * * * *